US011382464B2

(12) United States Patent
Thomas

(10) Patent No.: US 11,382,464 B2
(45) Date of Patent: Jul. 12, 2022

(54) PORTABLE WASHING STATION

(71) Applicant: Kurt Thomas, San Jacinto, CA (US)

(72) Inventor: Kurt Thomas, San Jacinto, CA (US)

( * ) Notice: Subject to any disclaimer, the term of this patent is extended or adjusted under 35 U.S.C. 154(b) by 0 days.

(21) Appl. No.: 17/071,733

(22) Filed: Oct. 15, 2020

(65) Prior Publication Data

US 2021/0106181 A1 Apr. 15, 2021

Related U.S. Application Data

(60) Provisional application No. 62/915,180, filed on Oct. 15, 2019.

(51) Int. Cl.
*A47K 3/28* (2006.01)
*A47K 3/32* (2006.01)

(52) U.S. Cl.
CPC ..... *A47K 3/325* (2013.01); *A47K 3/288* (2013.01); *A47K 2201/00* (2013.01)

(58) Field of Classification Search
CPC ..... A47K 3/324; A47K 3/288; A47K 2201/00
USPC ..... 4/603
See application file for complete search history.

(56) References Cited

U.S. PATENT DOCUMENTS 5,251,345 A * 10/1993 Pechner ..... A47K 3/325 4/603
6,049,919 A * 4/2000 Roteman ..... A47K 3/285 4/602
6,059,143 A * 5/2000 Weir ..... A45F 3/00 222/184
7,047,577 B1 * 5/2006 Cirilli ..... A47K 3/325 4/599
10,850,299 B2 * 12/2020 DiStefano ..... B05C 11/1026
2013/0001243 A1 * 1/2013 Quick ..... A47K 3/285 222/135
2016/0346803 A1 * 12/2016 Crawford ..... B05B 9/04

OTHER PUBLICATIONS

"Sink Twice", Etsy,https://docs.google.com/spreadsheets/d/1jANBiKabwYKGvAa7jdNzauZRACVBztKO5JkNuysin18/edit?usp=sharing, downloaded from the Internet Nov. 2, 2020, 1 page.
"Rinse Kit", Amazon,https://www.amazon.com/Rinse-Kit-Water-Sink-Adapter/dp/B013NVQ7SG/ref=sr_1_3?dchild=1&keywords=Rinse+Kit+portable+shower+with+hot+water+sink&qid=1604327943&sr=8-3, downloaded from the Internet Nov. 2, 2020, 1 page.
"Tye Works", Amazon,https://www.amazon.com/Tye-Works-Advanced-System-Sanitation/dp/B007QXK5MW/ref=sr_1_1?dchild=1&keywords=tye+works+advanced+hand+wash+system&qid=1604328055&sr=8-1, downloaded from the Internet Nov. 2, 2020, 1 page.
"Coldcreek Outfitters", Amazon, https://www.amazon.com/Coldcreek-Outfitters-Ultimate-Removable-Cleaning/dp/B01A5WCEWO/ref=sr_1_2?crid=B0H96JAJST6B&dchild=1&keywords=coldcreek+outfitters+outdoor+washing+table+and+sink&qid=1604328094&sprefix=coldcreek+outfitters+outdoor+washing+ta%2Caps%2C158&sr=8-2, downloaded from the Internet Nov. 2, 2020, 1 page.
Trofoty:, Amazon, https://www.amazon.com/Camping-Portable-Switchable-Traveling-Swimming/dp/B07T2GHC3F/ref=sr_1_1?c=ts&dchild=1&keywords=Camping+Showers&qid=1604346734&refinements=p_89%3ATrofoty&s=outdoor-recreation&sr=1-1&ts_id=3401561, downloaded from the Internet Nov. 2, 2020, 1 page.
(Continued)

*Primary Examiner* — Huyen D Le
(74) *Attorney, Agent, or Firm* — Lee Sullivan Shea & Smith LLP

(57) ABSTRACT

An example portable washing station may include a reservoir, a lid removably attached to the reservoir, an opening for receiving an extendable nozzle, a submersible pump positioned within the reservoir, a hose connecting the extendable nozzle and the submersible pump, and a battery electrically coupled to the submersible pump via a detachable power cord.

16 Claims, 8 Drawing Sheets

(56) References Cited

OTHER PUBLICATIONS

"Advanced Elements", Amazon, https://www.amazon.com/ADVANCED-ELEMENTS-5-Gallon-Solar-Shower/dp/B001Q3L716/ref=sr_1_1?crid=3NL6N4GBDMOCF&dchild=1&keywords=advanced+elements+5+gallon+summer+shower&qid=1604328324&sprefix=advanced+elements+5+gall%2Caps%2C148&sr=8-1, downloaded from the Internet Nov. 2, 2020, 1 page.
"Sportneer", Amazon, https://www.amazon.com/Sportneer-Removable-Switchable-Traveling-Hiking-20L/dp/B07SW5J1TK/ref=sr_1_1?crid=1XFORJGUMTVHI&dchild=1&keywords=sportneer+solar+shower+bag&qid=1604328404&sprefix=sportneer+solar+%2Caps%2C155&sr=8-1, downloaded from the Internet Nov. 2, 2020, 1 page.
"Cartman", Amazon, https://www.amazon.com/CARTMAN-Portable-Camping-Shower-Gallons/dp/B019SYOY3M/ref=sr_1_3?dchild=1&keywords=cartman+portable+solar+camping&qid=1604328448&sr=8-3, downloaded from the Nov. 2, 2020, 1 page.
"Nemo", Amazon, https://www.amazon.com/Nemo-Helio-Pressure-Shower-Verglas/dp/B083BHZY8K/ref=sr_1_1?dchild=1&keywords=nemo%2Bhelio%2Bportable%2Bpressure%2Bshower&qid=1604328556&sr=8-1&th=1, downloaded from the Internet Nov. 2, 2020, 1 page.
"OYOOQO", Amazon, https://www.amazon.com/OYOOQO-Portable-Pressure-Outdoor-Cleaning/dp/B07STJH3RH/ref=sr_1_3?dchild=1&keywords=oyooqo+camping+shower&qid=1604328638&sr=8-3, downloaded from the Internet Nov. 2, 2020, 1 page.
"Camp Chef", Amazon, https://www.amazon.com/Camp-Chef-Triton-Water-Heater/dp/B07GNT31CN/ref=sr_1_4?dchild=1&keywords=camp+chef+water+heater&qid=1604329534&sr=8-4, downloaded from the Internet Nov. 2, 2020, 1 page.
"Spy Tec", Amazon, https://www.amazon.com/Streamline-Portable-Camping-Expandable-Removable/dp/B07PRD3T9P/ref=sr_1_8?dchild=1&keywords=spy+tec+portable+camping+shower&qid=1604345989&sr=8-8, downloaded from the Internet Nov. 2, 2020, 1 page.
"Zanmax", Amazon, https://us.amazon.com/dp/B07SQ8PG95/ref=dp_cerb_3, downloaded from the Internet Nov. 2, 2020, 1 page.
"Reliance Products", amazon, https://www.amazon.com/Reliance-Products-Pressurized-Portable-Showever/dp/B01MY6CZ6J, downloaded from the Internet Nov. 2, 2020, 1 page.
"Baban", Amazon, https://www.amazon.ca/Portable-Collapsible-Baban-Rechargeable-Showerhead/dp/B07BC7569M, downloaded from the Internet Nov. 2, 2020, 1 page.
"OnTrackGear", Amazon, https://www.amazon.com/OnTrackGear-Outdoor-Portable-Camping-Mini-Transition/dp/B072T4SVFJ/ref=cm_cr_arp_d_product_top?ie=UTF8, downloaded from the Internet Nov. 2, 2020, 1 page.
"Coleman", Amazon, https://www.amazon.com/Coleman-Demand-H2Oasis-Portable-Heater/dp/B01C7HF0NU, downloaded from the Internet Nov. 2, 2020, 1 page.

* cited by examiner

PORTABLE WASHING STATION

CROSS-REFERENCE

This application claims the benefit of priority to U.S. Provisional Application No. 62/915,180 filed on Oct. 15, 2019 and titled "Portable Washing Station," the contents of which are herein incorporated by reference in their entirety.

BACKGROUND

A portable washing station can be useful in many situations where there is no access to a water source for convenient rinsing and washing of hands and other items. For example, a portable washing station may be used at construction worksites, on camping trips, or at the beach, among many other uses. However, many existing portable washing stations are relatively cumbersome to use, overly complicated, or simply are not flexible enough to meet a user's many possible needs. Therefore, an improved portable washing station that is self-contained and relatively easy to transport, operate, and reuse is desired.

SUMMARY

In one aspect, disclosed herein is a portable washing station including (i) a reservoir, (ii) a lid removably attached to the reservoir, (iii) an opening for receiving an extendable nozzle, (iv) a submersible pump positioned within the reservoir, (v) a hose connecting the extendable nozzle and the submersible pump, and (vi) a battery electrically coupled to the submersible pump via a detachable power cord.

It should be appreciated that many other features, applications, embodiments, and variations of the disclosed technology will be apparent from the accompanying drawings and from the following detailed description. Additional and alternative implementations of the structures and methods described herein can be employed without departing from the principles of the disclosed technology.

BRIEF DESCRIPTION OF THE DRAWINGS

The drawings are for the purpose of illustrating example embodiments, but it is understood that the present disclosure is not limited to the arrangements and instrumentality shown in the drawings.

DETAILED DESCRIPTION

The following disclosure makes reference to the accompanying figures, which illustrate example embodiments of the portable washing station disclosed herein.

The present disclosure is generally directed to an improved portable washing station that is self-contained and relatively easy to transport, operate, and reuse. At a high level, the disclosed portable washing station may include a reservoir and various fixtures for facilitating sanitizing and washing of hands and/or other items. The reservoir may be capable of holding a volume of liquid (e.g., water or other cleaning solution) for a user's needs during operation of the portable washing station.

Figure 1A:
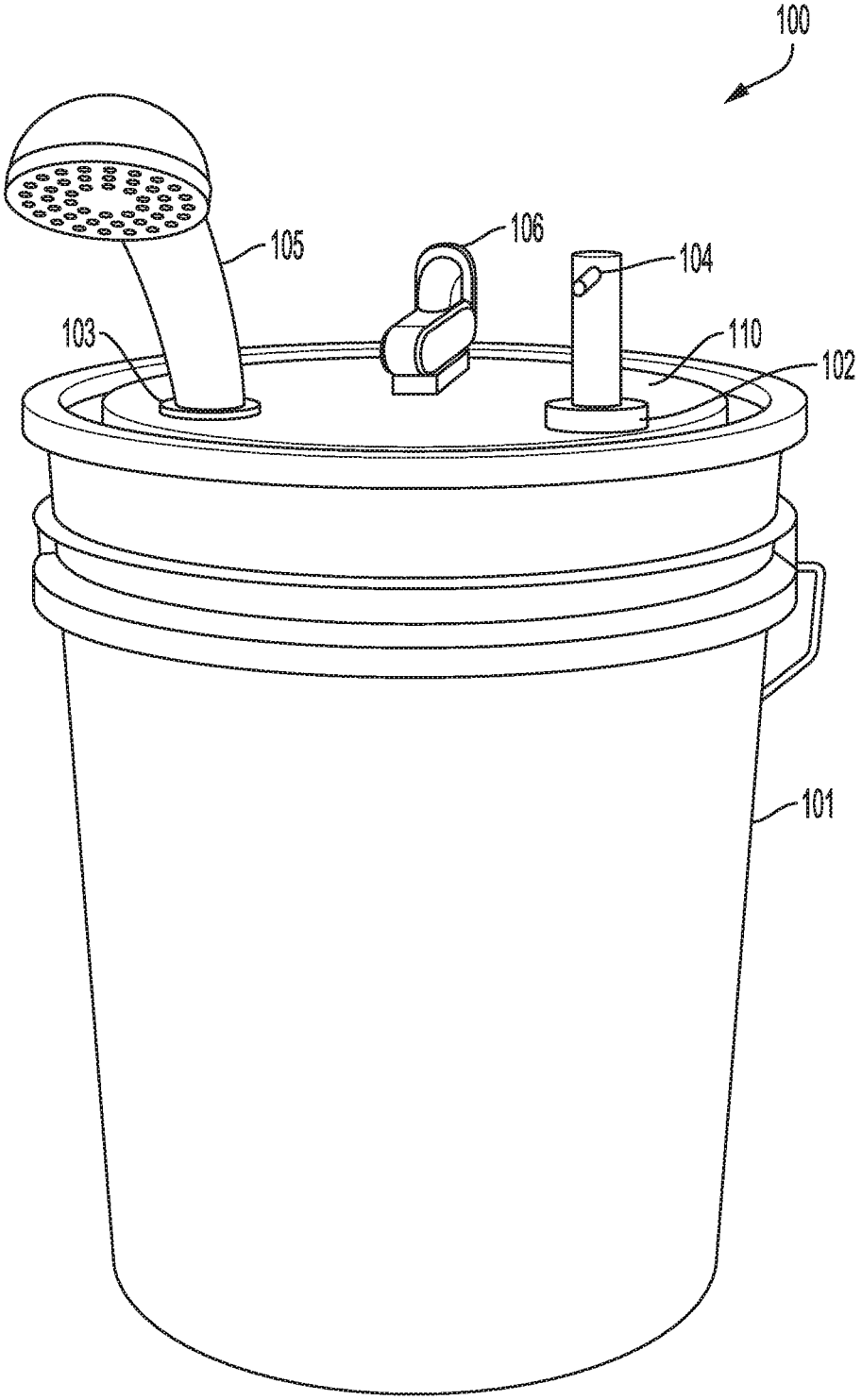
FIG. 1A depicts an example portable washing station according to one embodiment of the present disclosure.

FIG. 1A shows an example embodiment of the disclosed portable washing station. The example portable washing station 100 may include a reservoir 101 for holding a volume of water or some other liquid solution to be used during washing operations. The volume may be sufficient for several uses, or for some sustained use, but not so great as to make the portable washing station prohibitively heavy when full. For example, a typical volume for the reservoir may be approximately five gallons, although other volumes are also possible.

The reservoir 101 may be formed from a variety of materials capable of holding liquid and supporting the fixtures described herein. In some implementations, for example, the reservoir may be formed from high-density polyethylene (HDPE). Other materials are also possible. Furthermore, the reservoir may comprise various shapes. As shown in FIG. 1A, the reservoir 101 is generally cylindrical. However, the reservoir may take other shapes as well, such as a cubic or rectangular shape. Numerous other shapes are also possible.

As mentioned above, the reservoir may include one or more fixtures. Such one or more fixtures may extend from the reservoir. As shown in FIG. 1A, the reservoir 101 may include a removable lid 110 having various openings, such as openings 102 and 103, for supporting fixtures that may be housed within the reservoir 101 and extend outwardly from the reservoir 101 through lid 110. The lid 110 may be completely or partially removable or otherwise openable in order to facilitate filling or cleaning the reservoir and/or accessing other components housed within the reservoir.

The fixtures extending from the reservoir 101 may include various possibilities. As shown in FIG. 1A, such fixtures may include at least a nozzle 105 used for discharging the water or liquid held within the reservoir 101 during washing operations. The fixtures may also include a dispenser 104, such as a pump-operated dispenser for dispensing liquid soap. Other fixtures are also possible.

In some implementations, the fixtures may be integrated into the lid 110, as shown in FIG. 1A. In other implementations, the fixtures may be integrated into a portion of the lid that is fixed to the reservoir, and a separate portion of the lid may be removable or otherwise openable to fill the reservoir. In still further implementations, one or more of the fixtures may not be integrated into the lid of the reservoir, but rather a sidewall of the reservoir. For instance, the nozzle and dispenser may extend outwardly from the sidewall near a top end of the reservoir rather than extending from the lid of the reservoir. Other possibilities also exist.

Figure 1B:
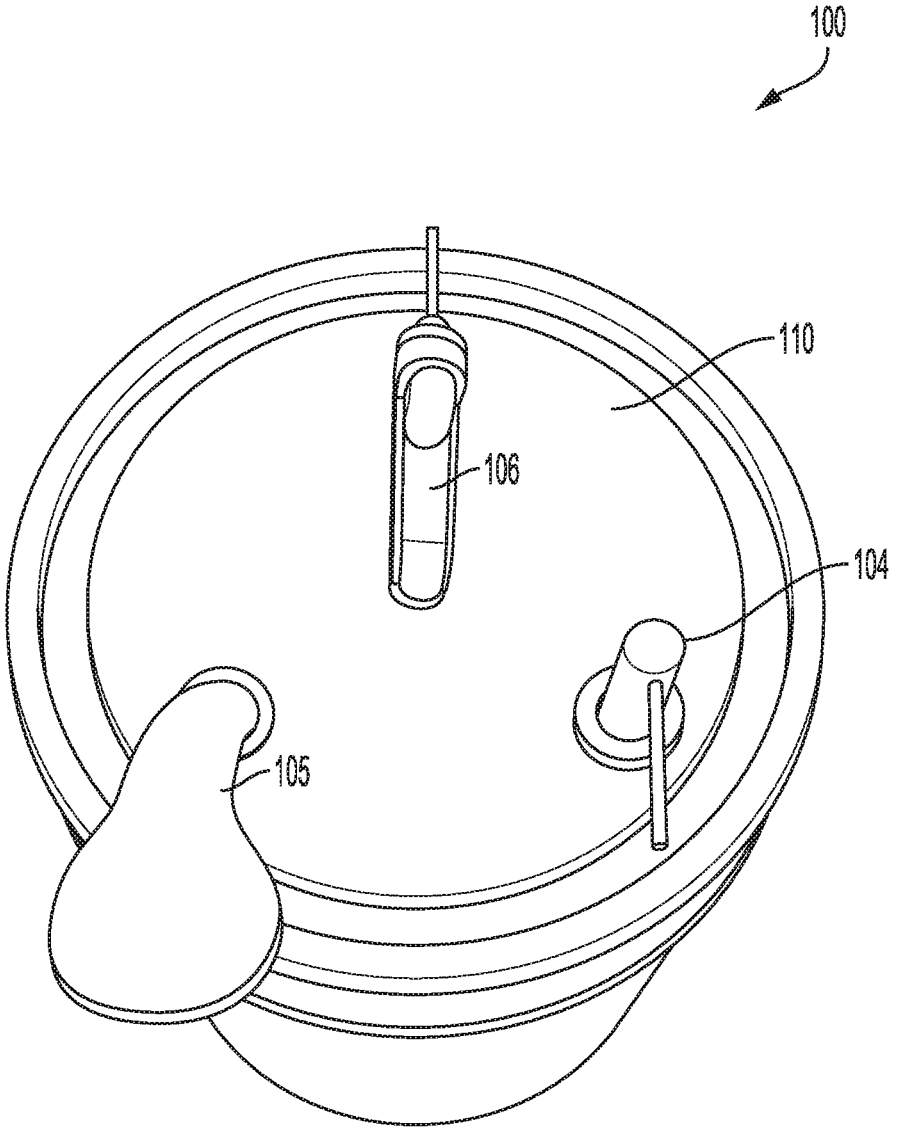
FIG. 1B depicts a top-down view of the example portable washing station of FIG. 1A.

Turning to FIG. 1B, a top-down view of the example portable washing station 100 is shown. As discussed above, the portable washing station 100 may include a removable lid 100 from which various fixtures, such as nozzle 105 and dispenser 104, may outwardly extend. As shown, the portable washing station 100 may further include a battery 106 housed in a housing that is affixed to the lid 110. The battery 106 will be discussed in more detail below with respect to FIG. 1H.

Figure 1C:
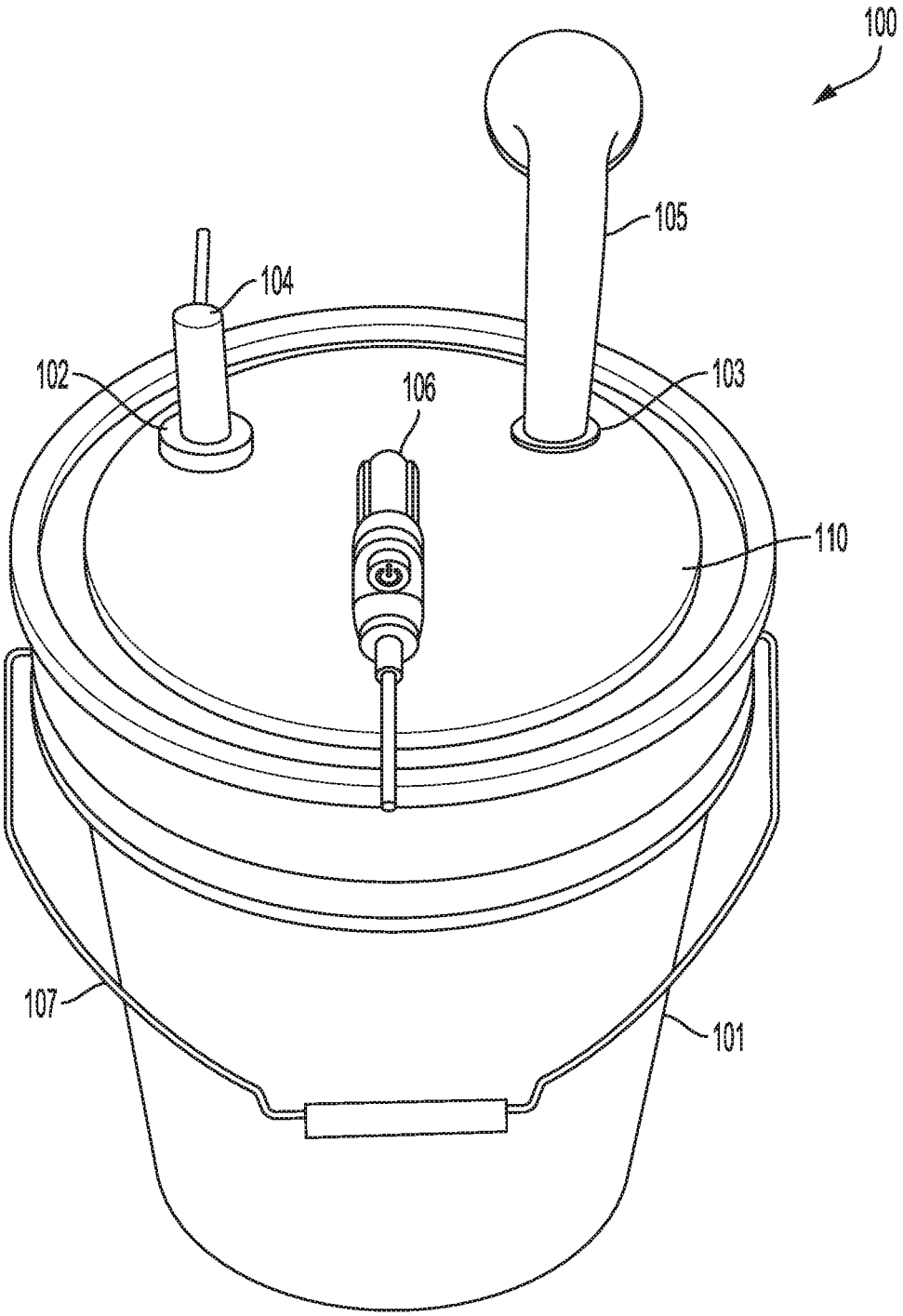
FIG. 1C depicts a rear view of the example portable washing station of FIG. 1A.

Turning to FIG. 1C, a rear-view of the example portable washing station 100 is shown. The battery 106 may be connected to a power cord 124 for powering a pump (discussed further below) located within the reservoir 101, and the power cord 124 may extend from the sidewall of the reservoir 101. Alternatively, the power cord 124 may extend from the lid 110. Additionally, the portable washing station 100 may further include a handle 107 for ease of carrying the portable washing station. Further the handle 107 may also operate to maintain the lid 110 of the reservoir in an open position. This may be desirable, for example, when refilling the reservoir 101 or accessing the components housed inside the reservoir 101, discussed in more detail below.

Figure 1D:
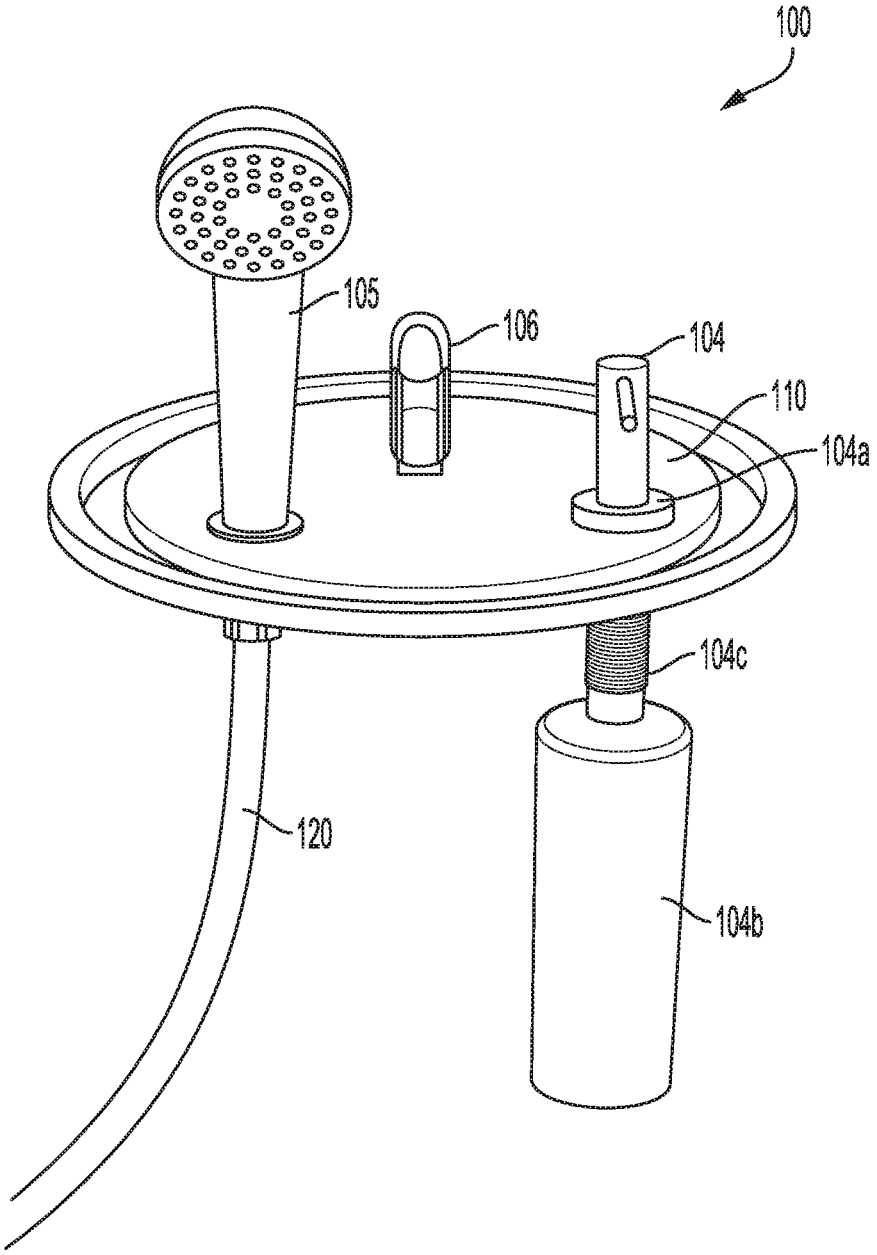
FIG. 1D depicts the lid when removed from the reservoir of the example portable washing station of FIG. 1A.

FIG. 1D depicts a view of the removable lid 110, along with the various fixtures, when removed from the reservoir 101. The dispenser 104 may be affixed to the lid 110 of the reservoir 101 via a threaded connection of a nut 104*a* and washer (not shown) on either side of the lid 110. Further, the dispenser 104 may be coupled to a vessel 104*b*, that may be filled with liquid soap or the like, for example, and is housed within the reservoir 101 of the portable washing station 100. For example, the vessel 104*b* may be submerged or partially submerged when the reservoir is filled with water, depending on the volume of water. In some implementations, the vessel 104*b* may rest on, or be affixed to, a bottom of the reservoir 101. The dispenser 104 may include a feed tube that extends into the vessel 104*b* and through which the liquid soap is pumped out of the dispenser. The feed tube of the dispenser may pass through a larger diameter, flexible tube 104*c* that joins the vessel 104*b* to the lid 110 and keeps the water in the reservoir 101 out of the vessel 104*b*.

Figure 1E:
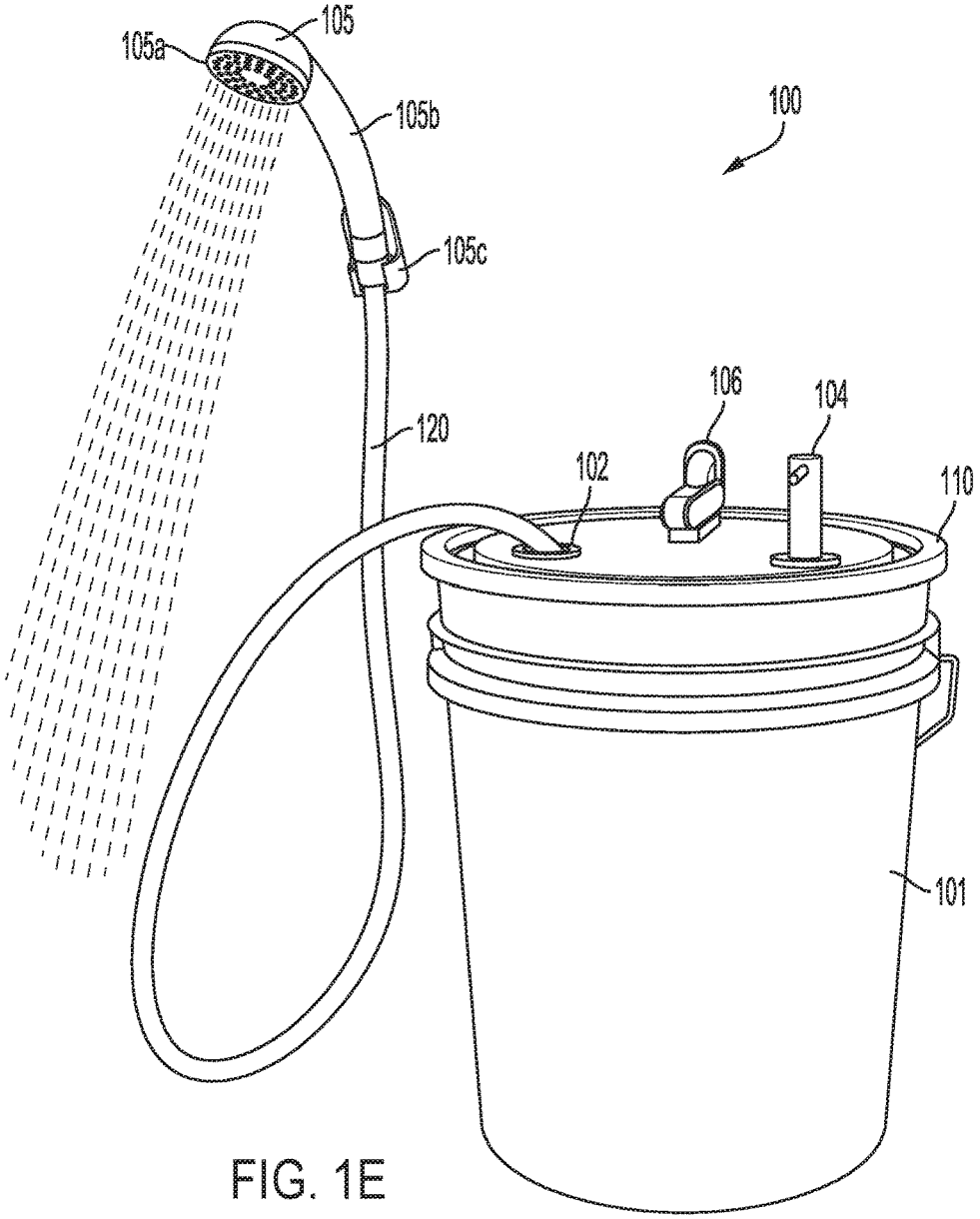
FIG. 1E depicts the nozzle and hose when extended from the reservoir of the example portable washing station of FIG. 1A.
Figure 1F:
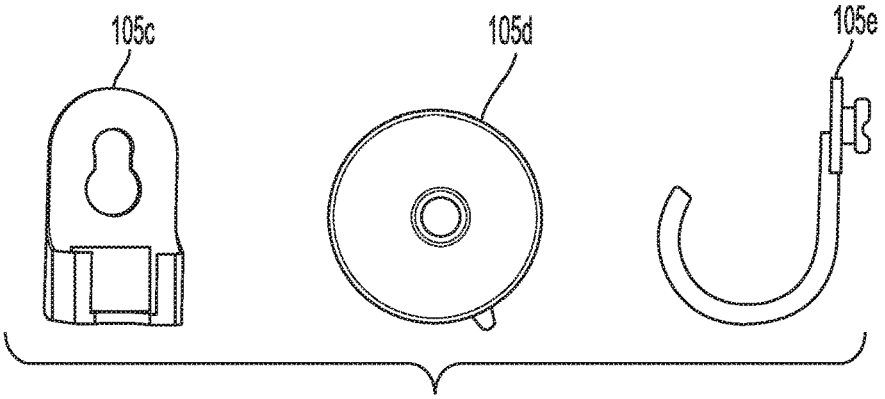
FIG. 1F depicts example mounting attachments that may be used in combination with the nozzle of the disclosed portable washing station.

As further shown in FIG. 1D, the nozzle 105 may be coupled to a hose 120 that is housed within the reservoir 101. As shown in FIG. 1E, the nozzle 105 may be disengaged from the lid 110 such that the nozzle 105 and hose 120 extend from the reservoir 101, providing a user with far more range and freedom of movement when operating the portable washing station 100. The hose 120 may be, for example, between 5 and 15 feet long. In some implementations, as shown, the nozzle 105 may include a head portion 105*a* from which the water discharges, and a handle portion 105*b* that is coupled to the hose 120. Additionally, or alternatively, the nozzle 105 and/or hose 120 may be coupled to a bracket 105*c* that can be used to affix the nozzle 105 and/or hose 120 to an external object (e.g., a wall, a car door, a tree, etc.) to keep the nozzle 105 and hose 120 in a fixed position when disengaged from the lid 110 while using the portable washing station 100. The nozzle 105 may also be affixed to other surfaces using different types of mounting attachments, such as the suction cup 105*d* or the hook 105*e* shown in FIG. 1F. Numerous other types of mounting attachments may be used as well. The handle portion 105*b* may be inserted into, and rest within, the opening 102 in the lid 110 such that the nozzle 105 is removable and replaceable by a user during operation. Accordingly, the hose 120 may extend from and retract into the reservoir via the opening 102.

Figure 1G:
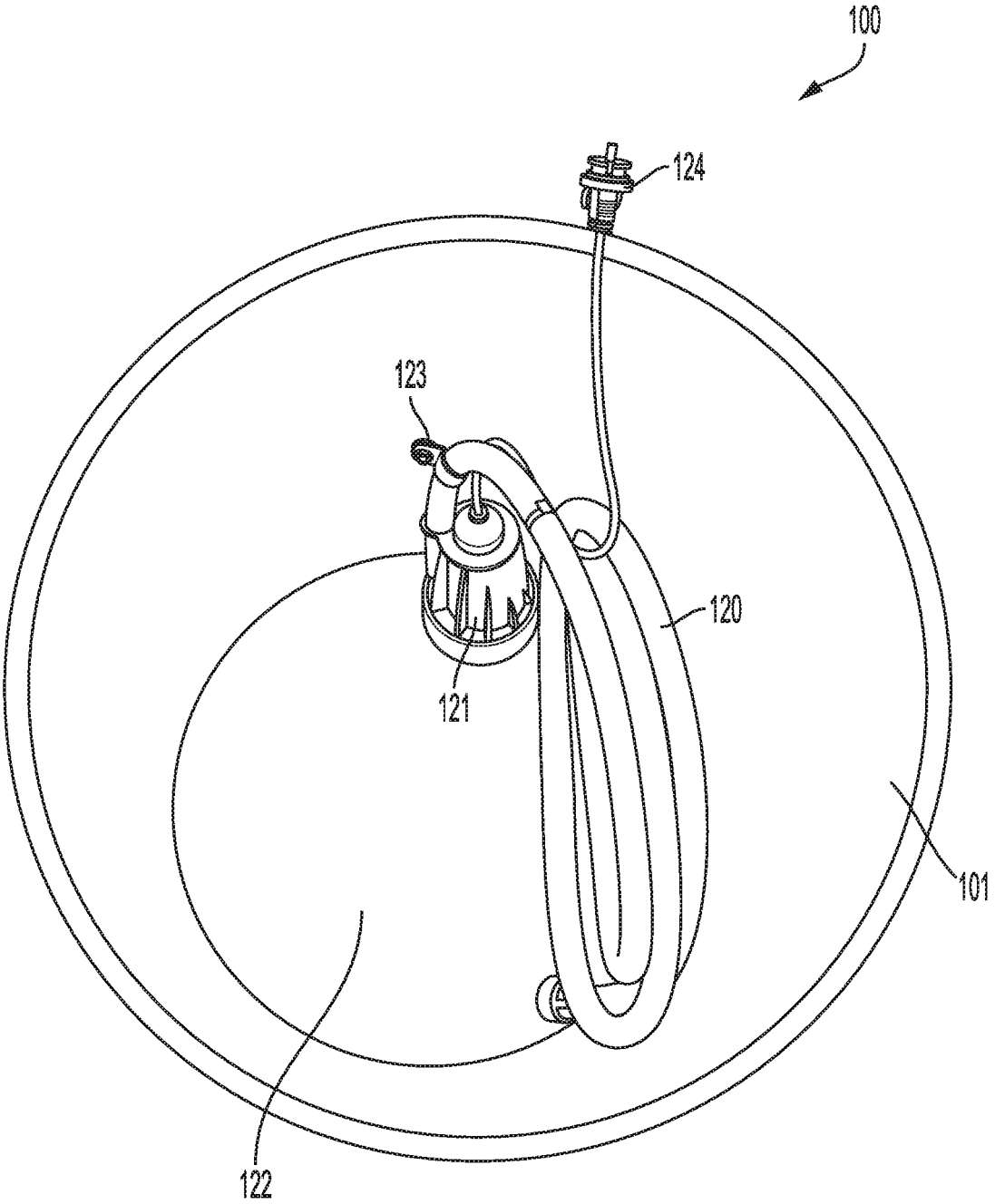
FIG. 1G depicts an interior view of the reservoir according to one embodiment of the disclosed portable washing station.

Turning to FIG. 1G, an example interior view of the portable washing station 100 is shown. The portable washing station 100 may also include a submersible pump 121, housed within the reservoir 101, that rests on or near a bottom 122 of the reservoir. In some implementations, the pump may have a discharge rate of approximately 4 liters per minute, for example. Other configurations are also possible.

As shown in FIG. 1G, the pump 121 may be connected to the hose 120 to pump the water or other liquid solution within the reservoir 101 through the hose 120 to the nozzle 105, thereby discharging the water or other liquid solution for use during operation. In some implementations, a fastener 123, such as a J-clamp, or other similar fixture, may secure the hose 120 to a sidewall of the reservoir 101, just above (e.g., between 3 and 6 inches above) the top of the pump 121. This configuration may help to maintain the pump 121 in a relatively stationary position at the bottom 122 of the reservoir 101. Further, securing the hose 120 and pump 121 in this way may reduce jostling and possible damage to the pump 121 when the portable washing station 100 is moved, especially when emptying the reservoir 101. The fastener 123, such as the J-clamp shown in FIG. 1G, may also serve as a stop that notifies the user when the hose has been fully withdrawn from the reservoir, without inadvertently pulling the hose 120 out of the pump 121 or otherwise damaging with pump 121. The fastener 123 may be secured to the sidewall of the reservoir 101 via a bolted connection through the sidewall that is closed with a watertight gasket to prevent leakage. Other configurations for the fastener 123, as well as other arrangements to maintain the pump 121 in a relatively fixed (e.g., stationary) position within the reservoir 101, are also possible.

The pump 121 may be battery-operated for both ease of use and portability. As shown in FIG. 1G, a power cord 124 may extend from the pump 121 to the battery 106 (discussed briefly above with respect to FIG. 1B) that may be removably fixed to the lid 110 of the reservoir 101. In some implementations, the power cord 124 may exit the reservoir 101 via a cutout in either the lid or the sidewall of the reservoir, along a top edge. In other embodiments, the power cord 124 may pass through a grommet in either the lid or the sidewall of the reservoir. Other examples are also possible. As shown in FIG. 1G, the power cord 124 may optionally be held in place alongside the hose 120 with a fastener such as a cable tie in order to prevent the power cord 124 from becoming entangled with or otherwise obstruct the other components housed within the reservoir 101.

Figure 1H:
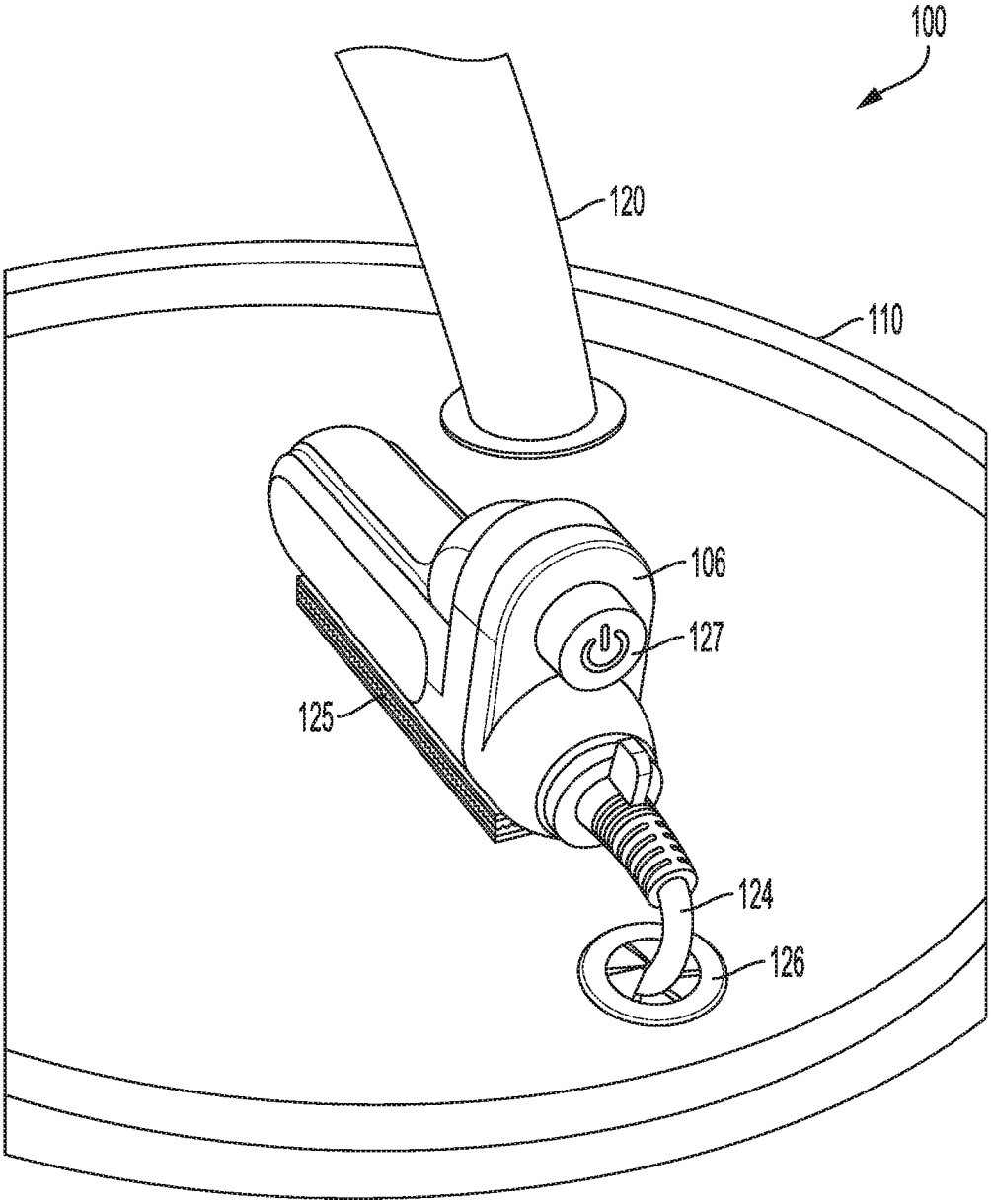
FIG. 1H depicts an example configuration of a battery according to one embodiment of the disclosed portable washing station.

Turning to FIG. 1H, an example configuration of the battery 106 is shown. The battery 106 that powers the pump 121 may be housed in a battery housing that is removably fixed to the lid 110 or another location on the exterior of the reservoir 101. For example, the battery housing may be affixed to the lid 110 of reservoir 101 via a hook-and-loop fastener 125. In other embodiments, the battery housing may be attachable to the reservoir via a hook, a clip, or some other engagement of male and female coupling parts. Furthermore, the power cord 124 may extend from inside the reservoir 101 through the lid 110 via a grommet 126. As further shown in FIG. 1H, the battery housing may also incorporate a switch 127 for powering the pump 121 on and off. For example, the switch 127 may be a push-button switch that can be used to toggle the pump 121 on and off with relative ease. Other arrangements for the switch 127, including a turnable knob or a rocker, are also possible. Further, in some implementations the switch 127 may be separately located from the battery housing. For example, the switch 127 may not be removable along with the battery 106, but rather may remain fixed to lid 110 or some other location of the reservoir 101 when the battery 106 is removed.

The battery 106 may be removed from the reservoir 101 by disconnecting the power cord 124 and then detaching the battery housing from the reservoir 101. The removability of the battery may allow it to be recharged while remote from the portable washing station 100, which may be advantageous when the portable washing station is not near a power source. Moreover, the relatively small size of battery housing compared to the portable washing station 100 may allow multiple batteries to be carried with the portable washing station 100, extending the operating time of the pump 121 accordingly.

An example battery may be, for instance, a lithium-ion battery with a voltage between 3 and 4 volts, having a capacity of approximately 2200 mAh. Operating a pump at a discharge rate of 4 liters per minute, the example battery may have a usage time of approximately 45-60 minutes. Other battery configurations are also possible.

Figure 2:
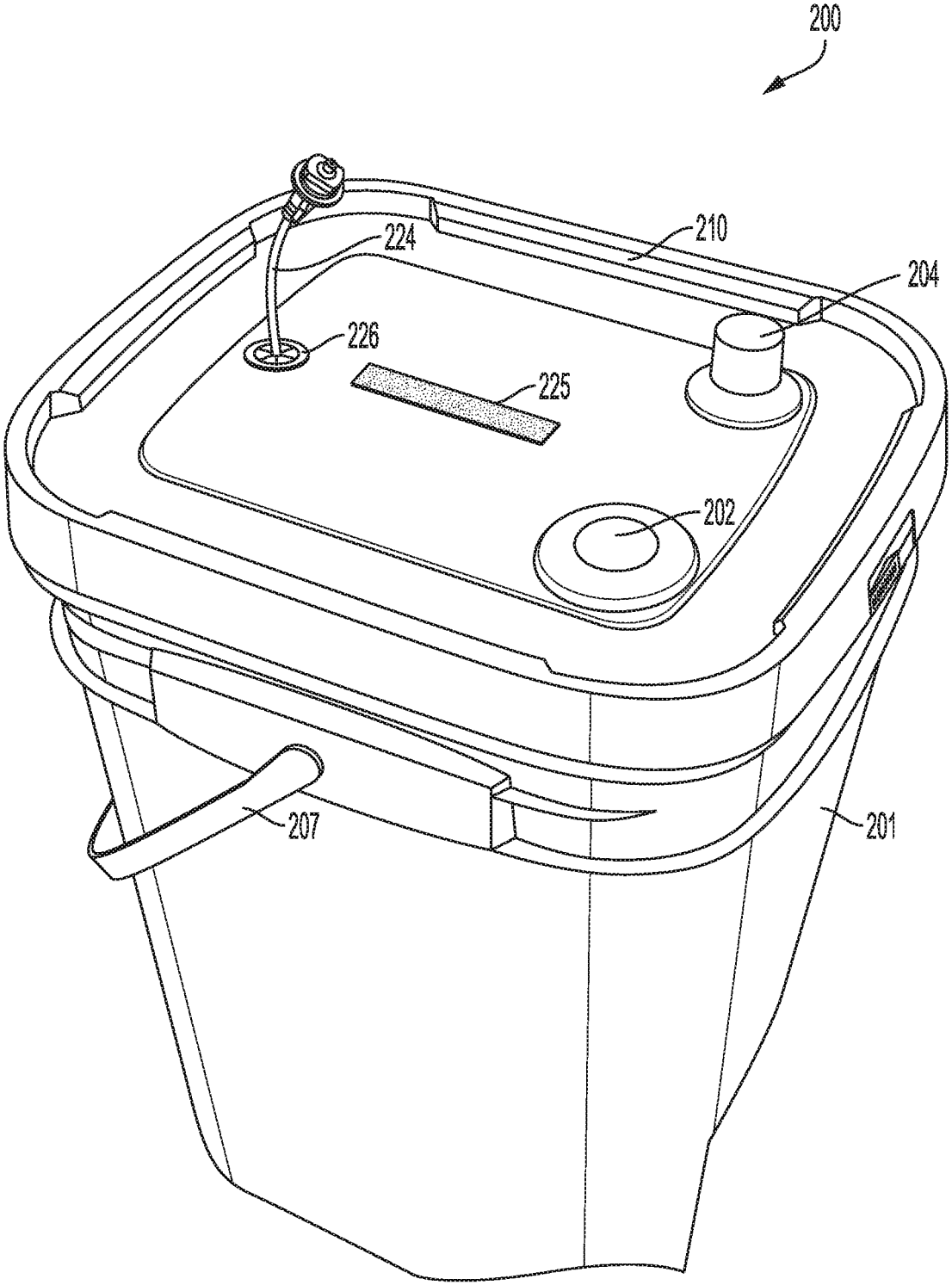
FIG. 2 depicts an example portable washing station according to another embodiment of the present disclosure.

As discussed above, the disclosed portable washing station may take various shapes and forms. FIG. 2 depicts an example portable washing station 200 that may take a rectangular shape. Regardless of the shape, the portable washing station 200 may include all of the features discussed above. The portable washing station 200 may include a reservoir 201 and a removable lid 210. The lid 210 may include an opening 202 through which a nozzle and/or hose (not shown) may extend and another opening 204 through which a dispenser (not shown) may extend. The lid 210 may further include a grommet 226 through which a power cord 224 (that may be connected to a submersible pump housed within the reservoir 201) may extend and connect to a battery (not shown) housed in a battery housing (not shown) that may be removably affixed to the lid 210 via a loop-and-hook fastener 225. The reservoir 201 may further include a handle 207 for easily transporting the power washing station 200 and/or maintaining the lid 210 in an open position, as discussed above. Although not shown in FIG. 2, the portable washing station 200 may also include all of the features discussed above that are housed within the reservoir 201, such as a hose, a submersible pump, and one or more fasteners for securing the submersible pump to a bottom or a sidewall of the reservoir 201 and maintaining the submersible pump in a relatively stationary position within the reservoir 201.

As noted above, the portable washing station disclosed herein may take other shapes as well.

It should be noted that the disclosed portable washing station may further include additional features not illustrated here. For example, in some embodiments, the reservoir may be formed from an insulating material such that the water within tends to maintain its temperature, either hot or cold, with respect to the ambient air. Additionally, or alternatively, the reservoir may comprise a double-walled or similar configuration to facilitate its insulating qualities.

Further, in some embodiments, the reservoir may include a heating element that warms the water within. The heating element may include a heating coil that is submerged in the reservoir, or a heating plate that is incorporated into the bottom of the reservoir, among other possibilities. The heating element may be actively powered by the battery in some cases, and may include separate controls (e.g., a separate switch) for doing so. In some other implementations, the heating element may be separately powered by its own battery or other power source. For example, the heating element may be connectable to a solar-powered panel or similar charger. In some implementations, a solar panel may be coupled to a power bank where power is stored until the heating element is engaged.

Still further, in some embodiments, the reservoir may include two or more wheels that may provide increased portability for the disclosed portable washing station.

As illustrated by the figures, the portable washing station generally discussed above advantageously requires relatively little user interaction to operate. For example, the switch may be manipulated with one hand, as can the dispenser and the nozzle. Further, the head of the nozzle may extend beyond the sidewall of the reservoir when the nozzle handle is in a fixed position relative to the lid, thus discharging the water clear over the sidewall of the reservoir and minimizing the need for the user to handle the nozzle at all during operation, if so desired. Such an arrangement may allow a user to easily utilize the portable washing station to rinse and/or wash his or her hands and/or any other items with relative ease.

Of course, the nozzle may also be extendable from the reservoir via the hose, as discussed above, which affords the portable washing station additional flexibility in directing the discharged water. The nozzle may also be affixed in an extended position, further maximizing user convenience. In some implementations, as described above with respect to FIGS. 1E-1F, the nozzle may include one or more hooks, hangers, or similar components for attaching it to an external, fixed support. For instance, the nozzle may be attached to a tree branch, a tent pole, or the top of a car door via a hook or similar fixture. This may facilitate rinsing or washing larger items, including operating as an overhead shower for the user. In some other implementations, the nozzle may be attached to a sufficiently smooth surface, such as a glass surface, via a suction cup. In yet other implementations, the nozzle may be attached to a flat surface such as a wall via a bracket. Other examples are also possible.

The different advantageous arrangements above have been presented for purposes of illustration and description and are not intended to be exhaustive or limited to the examples in the form disclosed. Many modifications and variations will be apparent to those of ordinary skill in the art. The example or examples selected are chosen and described in order to explain the principles of the examples, the practical application, and to enable others of ordinary skill in the art to understand the disclosure with various modifications as are suited to the particular use contemplated.

The invention claimed is:

1. A portable washing station comprising:
- a reservoir;
- a lid removably attached to the reservoir;
- an opening in the lid for receiving a removable nozzle;
- a submersible pump positioned within the reservoir;
- a flexible hose connecting the removable nozzle and the submersible pump, wherein the flexible hose is at least partially positioned within the reservoir and is outwardly extendable and inwardly retractable through the opening; and
- a battery electrically coupled to the submersible pump via a detachable power cord.

2. The portable washing station of claim 1, wherein the opening is a first opening, the portable washing station further comprising:
- a dispenser;
- a second opening for receiving the dispenser; and
- a vessel housed within the reservoir and connected to the dispenser through the second opening.

3. The portable washing station of claim 2, wherein the first opening and the second opening are located on the lid.

4. The portable washing station of claim 1, further comprising:

a mounting attachment for securing one or both of the removable nozzle or the flexible hose to an external object during operation of the portable washing station.

5. The portable washing station of claim 4, wherein the mounting attachment comprises one of: a bracket, a suction cup, or a hook.

6. The portable washing station of claim 1, further comprising:

a fastener positioned to secure the flexible hose to an interior sidewall of the reservoir.

7. The portable washing station of claim 1, wherein the battery is housed in a battery housing that is removably affixed to the lid.

8. The portable washing station of claim 7, wherein the battery housing is removably affixed to the lid via one of: a hook-and-loop fastener, a hook, or a clip.

9. The portable washing station of claim 7, wherein the battery housing comprises a switch for toggling power from the battery to the submersible pump.

10. The portable washing station of claim 1, further comprising:

a handle for carrying the portable washing station.

11. The portable washing station of claim 1, further comprising:

a grommet through which the detachable power cord is extendable outwardly from within the reservoir.

12. The portable washing station of claim 1, wherein the reservoir is formed from high-density polyethylene (HDPE).

13. A method of operating a portable washing station, the portable washing station comprising (i) a reservoir, (ii) a lid removably attached to the reservoir, (iii) an opening in the lid for receiving a removable nozzle, (iv) a submersible pump positioned within the reservoir, (v) a flexible hose connecting the removable nozzle and the submersible pump, wherein the flexible hose is at least partially positioned within the reservoir and is outwardly extendable and inwardly retractable through the opening, and (vi) a battery electrically coupled to the submersible pump via a detachable power cord, the method comprising:

at least partially filling the reservoir with a liquid;

removably attaching the lid to the reservoir; and discharging at least a portion of the liquid from the reservoir via the removable nozzle by powering on the submersible pump.

14. The method of claim 13, further comprising:

while discharging at least a portion of the liquid from the reservoir, extending the removable nozzle and the flexible hose outwardly from the reservoir via the opening.

15. The method of claim 13, wherein the portable washing station further comprises a mounting attachment, the method further comprising:

securing one or both of the removable nozzle or the flexible hose to an external object with the mounting attachment.

16. The method of claim 13, wherein the opening is a first opening, the portable washing station further comprising (i) a dispenser, (ii) a second opening for receiving the dispenser, and (iii) a vessel housed within the reservoir and connected to the dispenser through the second opening, the method further comprising:

at least partially filling the vessel with a liquid solution; and dispensing at least a portion of the liquid solution from the vessel via the dispenser.

* * * * *